United States Patent [19]

Ohta

[11] 4,079,816

[45] Mar. 21, 1978

[54] DAMPER DEVICE FOR ELEVATOR ROPE

[75] Inventor: Kazutoshi Ohta, Inazawa, Japan

[73] Assignee: Mitsubishi Denki Kabushiki Kaisha, Tokyo, Japan

[21] Appl. No.: 738,744

[22] Filed: Nov. 3, 1976

[30] Foreign Application Priority Data

Nov. 14, 1975 Japan ..... 50-137499

[51] Int. Cl.[2] ..... B66B 7/06

[52] U.S. Cl. ..... 187/1 R; 174/42; 187/20; 267/136

[58] Field of Search ..... 187/1 R, 1 A, 20, 22, 187/23; 188/1 B; 174/42, 146, 147; 248/358 R; 343/DIG. 1; 267/136

[56] References Cited

U.S. PATENT DOCUMENTS

| | | | |
|---|---|---|---|
| 3,666,051 | 5/1972 | Davis et al. | 187/20 |
| 3,991,856 | 11/1976 | Shigeta et al. | 187/1 R |

FOREIGN PATENT DOCUMENTS

| | | | |
|---|---|---|---|
| 599,214 | 1/1926 | France | 187/1 R |
| 1,406,220 | 10/1968 | Germany | 187/1 R |
| 1,431,865 | 11/1968 | Germany | 187/1 R |

*Primary Examiner*—John J. Love
*Assistant Examiner*—Jeffrey V. Nase
*Attorney, Agent, or Firm*—Wenderoth, Lind & Ponack

[57] ABSTRACT

A dynamic damper device includes a damping rod traversing several parallel hoisting ropes for an elevator car adjacent to the car and projecting beyond the outermost ropes. All the ropes are fixed to the damping rod by means of two opposite push plates, and fastening bolts. The rod has one of the projecting end portions longer than the other of the projecting end portions and is provided at the extremity with an additional weight. Thus the device has the center of gravity offset from the mid-point between the outermost ropes.

8 Claims, 5 Drawing Figures

DAMPER DEVICE FOR ELEVATOR ROPE

BACKGROUND OF THE INVENTION

This invention relates to a damping device for damping ropes or cables used with elevator systems.

When buildings shake in a strong wind, a lateral vibration is normally caused in the ropes or cables of the elevator systems serving such building for example, a hoisting rope for suspending an elevator car. In high buildings having a long hoisting rope, a very long time must pass until such lateral vibration has ceased. This is partly due to the fact that the hoisting rope itself has a small attenuation factor and this causes discomfort for passengers within an associated elevator car and it has sometimes created difficulty in the speed control of the elevator car. In order to damp the lateral vibrating movement of hoisting ropes, there have been previously proposed various damping devices. For example, it has been already proposed to dispose a suitable oil damper between a holder having a hoisting rope coupled thereto and the adjacent portion of the hoisting rope. This measure is disadvantageous in that due to the use of the oil damper, the resulting system is not easy to install and is expensive and its maintenance requires a large amount of labor.

It is an object of the present invention to provide a new and improved damper device for use with the ropes or cables of elevator systems which has a simple construction and low in cost.

SUMMARY OF THE INVENTION

The present invention provides a dynamic damper device for use with the ropes or cables of an elevator system comprising a plurality of ropes disposed in spaces parallel relationship within a hoistway and suspended from a stationary portion, a holding member connected to one end of the plurality of ropes, and a damper means disposed adjacent to the junction of the plurality of ropes and the holder means and having at least two of the ropes fixedly secured thereto, the damper means being non-resilient and substantially rigid and having a predetermined mass and having the center of gravity spaced in the direction between the ropes from the middle point between the outermost pair of ropes, the damper means engaging said ropes for effecting a swivelling motion about an axis parallel to the longitudinal axis along which the parallel ropes are arranged when the ropes are laterally rolled.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENT

Figure 1:
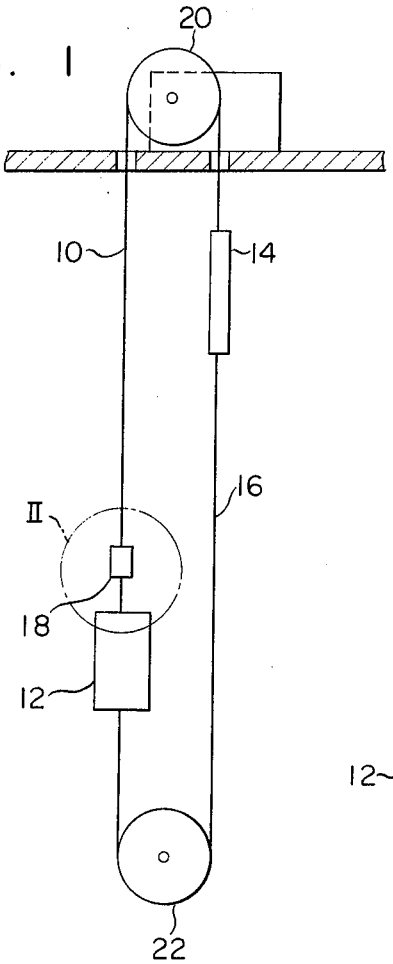
FIG. 1 is a schematic view of an elevator system utilizing a damper device for use with elevator ropes or cables are constructed in accordance with the principles of the present invention.

Referring now to FIG. 1 of the drawings, there is illustrated an elevator system including a dynamic damper device for elevator ropes or cables constructed in accordance with the principles of the present invention. The arrangement illustrated comprises a plurality of ropes or cables 10 (see FIG. 2) connected at one end to an elevator car 12 having a holding structure for the ropes and at the other ends to one end of a counter weight 14, a balancing rope 16 connected at one end to the other end of the counter weight 14 and at other end to the elevator car 12. The ropes 10 and the balancing rope 16 form a closed loop with the associated components and extend between a pair of upper and lower sheaves 20 and 22 respectively and within a hoistway (not shown).

The arrangement further comprises a damper assembly generally designated by the reference numeral 18 and connected to those portions of the hoisting ropes 10 adjacent to the junction of the latter and the elevator car or holding structure 12.

Figure 2:
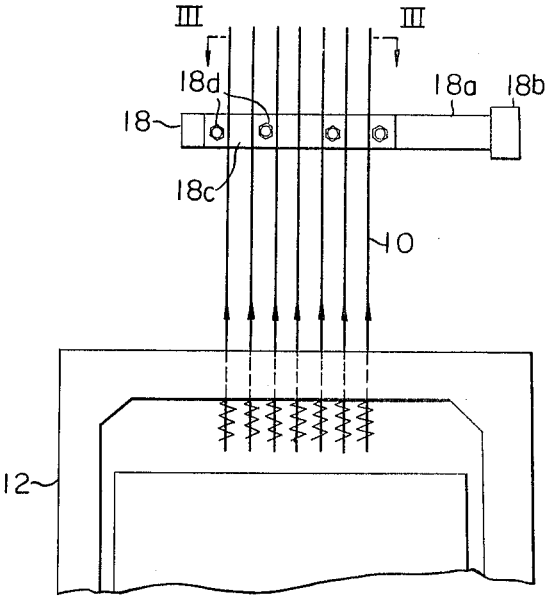
FIG. 2 is an enlarged side elevational view of that portion designated by the reference character II in FIG. 1 as viewed in a plane perpendicular to the plane of FIG. 1.

As shown in FIG. 2, the seven hoisting ropes 10 are disposed in parallel at substantially equal intervals to form a parallel array of ropes and have the damper assembly 18 perpendicularly connected to that portion of the parallel array of hoisting ropes 10 adjacent to the elevator car or holding structure 12.

Figure 3:
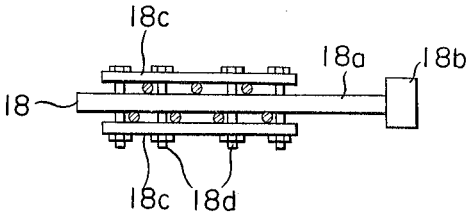
FIG. 3 is a cross sectional view taken along the line III—III of FIG. 2.
Figure 4:
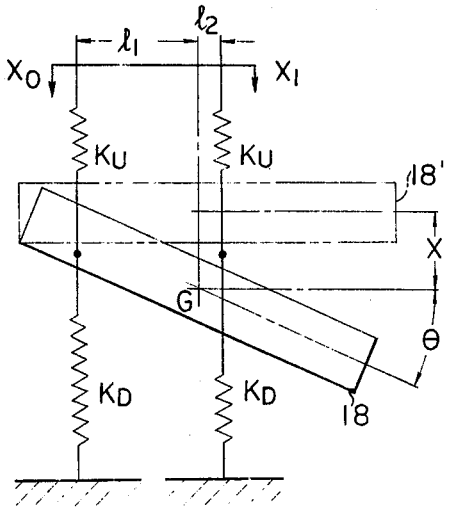
FIG. 4 is a diagrammatic plan view of a moving system substantially equivalent to the arrangement shown in FIG. 2.

As best shown in FIG. 3, the damper assembly 18 includes a rod-shaped damping member **18*a* perpendicularly traversing the parallel array of hoisting ropes 10 with both end portions thereof projecting beyond the adjacent edges of the parallel array of hoisting ropes 10, i.e. beyond the respective outermost ropes 10. One of the projecting end portions, in this case, the righthand end portion as viewed in FIG. 4, is longer than the other or lefthand end portion thereof and is provided at its extremity with an additional weight 18*b*. Further, alternate parallel ropes 10 contact one lateral surface of the damping member 18*a* and the remaining ropes contact the other lateral surface thereof. A pair of spaced opposed clamping plates 18*c* clamp the hoisting ropes 10 against the damping member 18*a* and a plurality of bolts in 18*d* in this case four are threaded through the clamping plates 18*a* and damping member 18*c* and 18*a* respectively and fastened to the clamping plates 18*c* by means of associated nuts to connect the damper assembly 18 into a unitary structure maintained in place on the parallel array of ropes 10**.

The damping member **18*a* is of any suitable material such as steel or wood having a suitable rigidity. Thus the damping assembly 18 has a suitable rigidity and a suitable mass as will be apparent hereinafter and also it has the center of gravity at a position spaced in the direction between the ropes, i.e. in the direction perpendicular to the ropes, from the middle point between the outermost ropes in the parallel array of ropes 10 as will be readily understood from the diagram of FIG. 4** and the foregoing description.

While the present invention has been illustrated and described in conjunction with seven ropes, it is to be understood that any desired number of hoisting ropes may be used but that at least two parallel ropes are required to be connected to the damper assembly 18. In the latter case each pair of the remaining ropes may be connected to a separate damper assembly.

That portion of the arrangement as shown in FIG. 2 and 3 including the damper assembly 18, the adjacent portions of the ropes and the holding structure 12 forms a moving system as illustrated in FIG. 4 wherein like reference numerals designate the components identical to those shown in FIG. 2. In FIG. 4 the damper assembly 18 is a fixedly secured to a pair of spaced ropes 10 and has the center of gravity G spaced at distances $l_1$ and $l_2$ from the lefthand and righthand outermost ropes respectively. The damper assembly 18 also has a mass M and its equilibrium position is designated by phantom like 18'. The ropes 10 fixedly secured at one end to the holding structure 12 of FIG. 2 have a lateral spring constant $K_U$ exhibited by those portions thereof located above the damper assembly 18 and a lateral spring constant $K_D$ exhibited by those portions thereof located under the damper assembly 18.

As is well known, the movement of the damper assembly 18 from its equilibrium position 18' to its position shown by solid line 18 can be broken down into a translational movement having a magnitude X and a rotational movement about the center of gravity G through an angle $\theta$. Also a horizontal displacement of the building or other structure in which the ropes are located, due to, for example, a wind causes a forced displacement $X_o$ of an upper holding structure (not shown) to which the other ends of the ropes 10 are connected within the building. Thus the ropes are forced to be moved laterally relative to the holding structure 12 by the same magnitude $X_o$.

From the foregoing it can be seen that the damper assembly 18 effects a motion defined by the following two differential equations:

$$M\ddot{x}+2(K_U+K_D)X+\{(l_1-l_2)K_UX+(l_1-l_2)K_D\}\theta = 2K_UX_6$$

and $$I\ddot{\theta}+\{l_1^2+l_2^2)K_U+(l_1^2+l_2^2)K_D\}\theta+\{(l_2-l_1)K_U+(l_1-l_2\}X = (l_2-l_1)K_UX_o$$

where $I$ is the moment of inertia of the damper assembly. Forcedly displacing each rope 10 by the same magnitude $X_o$, induces a rotational movement $\theta$ of the damping assembly 18. Therefore the ropes 10 are laterally vibrated resulting in a swivelling motion of the damping assembly 18 about an axis parallel to the longitudinal axes of the parallel ropes. Then this swivelling motion causes the laterally vibrated of the rope array to be transformed to a twisting motion whereby the lateral vibration energy is consumed. From the differential equation for $\ddot{\theta}$ it is seen that, by positioning the center of gravity of the damper assembly 18 so as to increase the ratio between the $l_2$ and $l_1$, the process just described acts more effectively cause the parallel ropes 10 to cease the lateral vibrating motion more rapidly.

Figure 5:
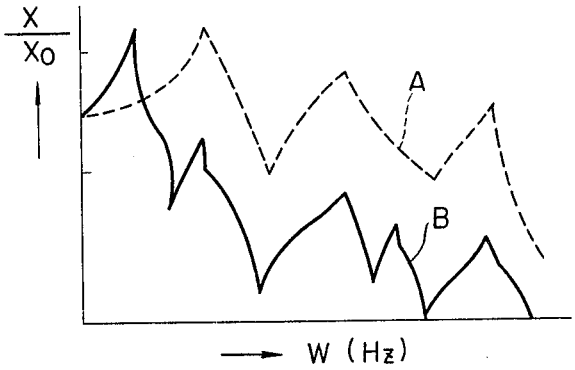
FIG. 5 is a graph illustrating the lateral vibration characteristic of ropes.

FIG. 5 shows the lateral vibration characteristic of ropes. In FIG. 5 a relative translational displacement $X/X_o$ is plotted on the ordinate against the lateral vibration frequency W in Hertz on the abscissa and the dotted curve labelled with the reference character A depicts the lateral vibration characteristics of an array of ropes disposed in spaced parallel relationship without a damper assembly such as above described while the solid curve labelled with the reference character B depicts the rolling characteristic of an array of ropes disposed in spaced parallel relationship with such a damping assembly. From FIG. 5 it is seen that an array of ropes with the damper assembly rapidly ceases the lateral vibrating movement as compared with the rope array without the damper assembly. This means that elevator systems utilizing the damper assembly of the present invention do not cause passengers within associated elevator cars any discomfort due to lateral vibration of the ropes, and the speed control of the elevator cars is not impeded. Further the damper assembly has a simple construction and has no component which is subject to wear and tear. Thus the present invention provides a damper device which is low in cost and easy to maintain.

It has been found that, by causing the natural motion frequency of the swivelling motion effected by the moving system of FIG. 4 to be approximately the same as either the natural lateral frequency of the holding structure 12 or the natural frequency of the lateral vibrating motion effected by the rope array at its specified position within an associated hoistway, a frequency range over which the damping effect is a maximum can be made to coincide with the frequency range over which the rope array has an increase in the magnitude of vibration, thereby effectively producing an offset effect. This results in an excellent dynamic damping effect upon the rope array.

In summary, the present invention provides a damping device for damping vibrations of a plurality of ropes disposed in spaced parallel relationship and connected at one end to a holding structure such as on an elevator car and suspended from a stationary portion of a structure such as a building, and wherein the damping device is disposed adjacent the junction of the ropes and the holding structure so as to have the center of gravity at a position offset from the middle point between the two outermost ropes, the arrangement being such that, the lateral vibration of the ropes causes a swivelling motion of the damper device about an axis parallel to the longitudinal axis along which the ropes are arranged. Thereby the lateral vibration energy possessed by the ropes is transformed to a twisting motion of the ropes to attenuate the motion. Therefore the damping device of the present invention can be manufactured inexpensively and is easy to maintain yet it prevents the occurrence of any trouble due to the lateral vibration of the ropes.

While the present invention has been illustrated and described in conjunction with a single preferred embodiment thereof it is to be understood that numerous changes and modifications may be resorted to without departing from the spirit and scope of the present invention. For example, the arrangement as shown in FIGS. 3 and 4 is equally applicable to a rope for use with an elevator governor. Also the damper assembly 18 may be disposed on that portion of the rope array 10 adjacent to the counter weight 14 to damp the lateral vibration of the rope array. Further it may be disposed on that portion of the balancing rope 16 adjacent to the holding structure 12 or the counter weight 14 where the balancing rope 16 has been formed of a plurality of rope sections, thereby to damp the lateral vibration of a corresponding rope array. In addition, a suitable attenuator may be connected at one end to the extremity of the longer one of the projecting end portions of the damping member 18*a* and be and at the other end to the holding structure 12 disposed in a horizontal plane including the junction of the same and the longer projecting end portion of the damping member. Such attenuator is not illustrated. Such an attenuator will enhance the effect of damping the lateral vibration of the ropes 10.

What is claimed is:

1. A dynamic damper device for use with the ropes of elevator systems, comprising a plurality of ropes disposed in spaced parallel relationship within a hoistway and suspended from a stationary portion, a holding member coupled to one end of said plurality of ropes, and damper means disposed adjacent to the junction of said plurality of ropes and said holding member and having at least two of said ropes fixedly secured thereto, said damper means being non-resilient and substantially rigid, and having a predetermined mass and having the center of gravity spaced in the direction between the ropes from the middle point between the outermost pair of ropes, the damper means engaging said ropes for effecting a swivelling motion about an axis parallel to the longitudinal axis along which the parallel ropes are arranged when the ropes are laterally vibrated.

2. A dynamic damper device as claimed in claim 1, wherein said ropes are hoisting ropes and said holding member comprises an elevator car.

3. A dynamic damper device as claimed in claim 1, wherein said ropes are hoisting ropes and said holding member comprises a counter weight.

4. A dynamic damper device as claimed in claim 1, wherein said ropes are a plurality of balancing ropes disposed in spaced parallel relationship and said holding member comprises an elevator car.

5. A dynamic damper device as claimed in claim 1, wherein said ropes are a plurality of balancing ropes disposed in spaced parallel relationship and said holding member comprises a counter weight.

6. A dynamic damper device as claimed in claim 1, wherein said ropes are a plurality of ropes for an elevator governor and said holding member comprises an elevator car.

7. A dynamic damper device as claimed in claim 1, wherein said damper means has a rigid rod-shaped damping member disposed in an array of said parallel ropes so as to project beyond the outermost ropes, one of projecting end portions of said damping member projecting beyond the outermost ropes more than the other of the projecting end portions, an additional weight fixedly secured to the end portion of said damping member projecting farthest beyond the outermost ropes, a pair of clamping plates disposed opposite both lateral surfaces of said damping member and sandwiching and holding said ropes between the clamping plates and the damping rod, and fastening means fastening said clamping plates to said damping rod.

8. A dynamic damper device as claimed in claim 1, wherein the ratio between the distance of said center of gravity from one of the outermost ropes and the distance of said center of gravity from the other outermost rope is large.

* * * * *